United States Patent [19]

Hauslaib

[11] Patent Number: 4,643,603

[45] Date of Patent: Feb. 17, 1987

[54] PRINTER FEEDER FOR EDGE-PUNCHED RECORD CARRIERS

[75] Inventor: Wolfgang Hauslaib, Langenau, Fed. Rep. of Germany

[73] Assignee: Mannesmann Aktiengesellschaft, Duesseldorf, Fed. Rep. of Germany

[21] Appl. No.: 719,245

[22] Filed: Apr. 2, 1985

[30] Foreign Application Priority Data

Apr. 3, 1984 [DE] Fed. Rep. of Germany ..... 3412853

[51] Int. Cl.[4] ..... B41J 11/32

[52] U.S. Cl. ..... 400/616.1; 226/74; 74/606 R; 400/642

[58] Field of Search ..... 400/616, 642, 616.1, 400/645, 616.2, 647; 226/74, 76, 86, 176, 199; 74/606 R, 421 R; 101/111

[56] References Cited

U.S. PATENT DOCUMENTS

| | | | |
|---|---|---|---|
| 3,455,174 | 7/1969 | Pickles | 74/606 R |
| 3,916,725 | 11/1975 | Reber | 74/606 R |
| 4,206,859 | 6/1980 | Plaza | 226/74 |
| 4,269,522 | 5/1981 | Levinson et al. | 400/616.1 |
| 4,345,708 | 8/1982 | Hubbard | 226/74 |
| 4,440,516 | 4/1984 | Rosenthal | 400/616.2 |
| 4,454,975 | 6/1984 | Rosenberg | 226/74 |
| 4,500,023 | 2/1985 | Akazawa | 226/199 |
| 4,524,638 | 6/1985 | Van Hee | 74/606 R |
| 4,524,686 | 6/1985 | Karn | 101/111 |

FOREIGN PATENT DOCUMENTS

| | | | |
|---|---|---|---|
| 49016 | 4/1982 | European Pat. Off. | 400/616.1 |

*Primary Examiner*—William Pieprz

*Attorney, Agent, or Firm*—Oblon, Fisher, Spivak, McClelland, & Maier

[57] ABSTRACT

A feeder for an edge-punched record carrier (3) which can be installed on existing printers with only slight structural changes on the printer. To be able to process continuous record carriers trouble-free even in an unfavorable position of the paper supply, with a method of construction that is suitable for mass production and in which the parts can be economically produced and mounted, the feeder (6) forms a self-supporting frame including side supports (*7a, 7b*) which can be connected to the printer frame (1*a*) by means of a pair of suspension hooks (13, 14) provided on each side support (*7a, 7b*). The suspension hooks (13, 14) are mounted on corresponding fastening bolts (15, 16). A cover (18) for the drive elements is mounted on one of the side supports (*7a, 7b*). A catch (17) is provided on the cover (18) which serves to maintain the feeder (6) in operating position.

6 Claims, 2 Drawing Figures

PRINTER FEEDER FOR EDGE-PUNCHED RECORD CARRIERS

FIELD OF THE INVENTION

The invention relates to a printer feeder for edge-punched record carriers. The printer feeder is formed from a fastening rod and a rotating drive shaft in parallel position. Tractors, placed on the fastening rod and the drive shaft, move in parallel and axially symmetrically to one another.

BACKGROUND OF THE INVENTION

Printer feeders for edge-punched record carriers serve the purpose of pulling and guiding record carriers (e.g., edge-punched paper webs) straight through the printer. A prerequisite for the course of the operation in the printer is a trouble-free feeding of the record carrier stacked in folded layers. Working from the stack is gaining importance due to the increasing processing of continuous forms.

Supporting the fastening rod and drive shaft for the tractors on the printer frame is known from German Published Patent Document DE-PS 25 14 506. However, a later retrofitting of printers already in operation with the device disclosed in this published patent document is not possible because the structural space is otherwise occupied. Thus, already existing printers cannot be retrofitted or can be retrofitted only with considerable difficulties with a feeder for edge-punched record carriers as disclosed in this published patent document. On the other hand, there is a demand for printers optionally with or without paper feeders.

OBJECTS OF THE INVENTION

The principle object of the invention is to provide a feeder for edge-punched record carriers which can also be installed on existing printers. Accordingly, the changes in the printer must be kept within narrow limits.

A further object of the invention is to provide a feeder for edge-punched record carriers in which continuous record carriers may be processed troublefree even with an unfavorable location of the paper supply.

A still further object of the invention is to provide a feeder for edge-punched record carriers in which the design of the feeder is suitable for mass production, and the parts may be economically produced and assembled.

SUMMARY OF THE INVENTION

The objects of the invention are achieved by a feeder which is made as a self-supporting frame from side supports and which can be connected to the printer frame by means of a pair of suspension hooks provided on each of the side supports in position to engage corresponding fastening bolts. A cover for the drive elements is mounted on at least one of the side supports. A catch is provided on the cover to maintain the feeder in its operating position. The invention makes possible a simple retrofitting of a printer with paper feeder, so that the printer can be supplied at first without a paper feeder.

The connection of the tractor parallel guide with the drive parts to a single unit is advantageous. Accordingly, the cover together with the side supports form a housing, closed to a very large extent, for a gear reduction unit with at least one gear step and several idler gears. The first gear meshes with a gear on the platen shaft, and the last gear of the gear train is connected to the drive shaft.

Production of the feeder is advantageously made economical by journals for the gears being formed on the inside of the cover. These journals have heads which serve as catches between the cover and the side support.

The parallelism of the two side supports and thus of the fastening rod and drive shaft is obtained very accurately by the fastening rod for the tractors being axially adjustable relative to one or both of the side supports.

Precision in guiding the paper is additionally increased by the tractors being provided in each case with guide walls which guide the record carrier. These guide walls extend crosswise to the fastening rod or drive shaft. The guide elements are made as guide walls to correct a skewed entry of the paper web. Adjustment of the tractor to the width of the paper additionally causes an adjustment of the guide walls to the intended paper width.

According to additional features, the necessary volume of the feeder is not increased by the guide walls if the guide walls are retractable to a position parallel to the fastening rod or drive shaft.

Precision in guiding the paper can be improved even further by fastening a wing or lug to the end of the guide walls, extending in each case perpendicularly to the advance direction of the record carrier. These wings or lugs, together with the printer frame, form a guide shoulder for the record carrier. At the same time, this guide shoulder prevents a faulty insertion of the paper width. The guide walls and lugs keep the paper web from being able to move freely between the guide walls, the printer frame, and other printer components.

Guiding of the paper web is further assisted by a movable support for the record carrier being provided on the fastening rod and drive shaft between the tractors.

DETAILED DESCRIPTION OF THE PRESENTLY PREFERRED EMBODIMENT

Figure 1:
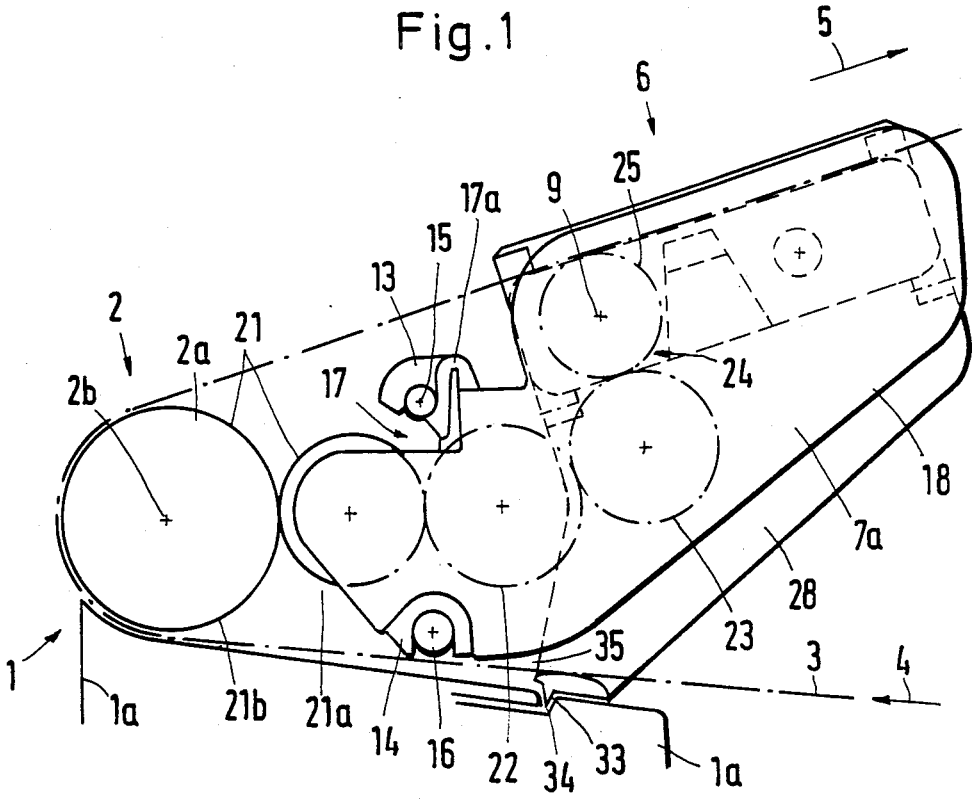
FIG. 1 is a side view of the feeder in operation position on the printer.

A printer 1 has a frame 1*a* and a print counter support 2. The print countersupport 2 is formed from a platen 2*a* mounted on a platen shaft 2*b*. The printer 1 receives a record carrier 3 from a supply bin (not shown). The record carrier 3 enters the printer 1 in the direction signified by the arrow 4 and, after being printed on, leaves the printer 1 in the direction signified by the arrow 5.

A feeder 6 (shown in detail in FIG. 2) is in the operating position in FIG. 1. The feeder 6 is mounted on a self-supporting frame including a side supports 7*a* and a side support 7*b*. The side support 7*a* and 7*b* are connected by a fastening rod 8 and a drive shaft 9. The drive shaft 9 is rotatably mounted in bearings 9*a* and 9*b*. A gear 25 on the drive shaft 9 contains the bearing 9*a*, and the bearing 9*b* is contained in a bearing cap. The fastening rod 8 and the drive shaft 9 are parallel to one another. Similarly, the side supports 7*a* and 7*b* are parallel to one another.

Tractors 10*a* and 10*b* are placed axially symmetrically to one another on the fastening rod 8 and the drive shaft 9. The relative positions of the tractors 10*a* and 10*b* can be adjusted for varying widths of the record carrier 3. The tractors 10*a* and 10*b* each comprise a continuous belt 11 with inwardly pointing teeth (not shown) and pilot pins 12 sized, shaped, and positioned to engage the pin holes in the selvage of the record carrier 3.

As shown in FIG. 1, side supports 7*a* and 7*b* end in upper and lower suspension hooks 13 and 14, each of which is mountable on suitable fastening bolts 15 and 16 on the frame 1*a* of the printer 1. The weight of the feeder 6 is sufficient in itself to guarantee a secure position to the feeder 6. Still greater security is obtained by a catch 17 which is formed on a cover 18 in the form of an elastic hook 17*a*. The cover 18 consists of an injectable material (e.g., a plastic), so that the elastic hook 17*a* can be formed at the same time as the cover 18.

The cover 18, together with the side support 7*a*, forms a housing 19 for protecting a gear reduction unit 20. As shown in FIG. 1, the gear reduction unit 20 includes a gear step 21, idler gears 21*a*, 22, and 23, and another gear step 24. The gear 25, which is mounted rotatably on the drive shaft 9, is a component of the gear step 24. A gear 21*b*, which is a component of the gear step 21, has approximately the same diameter as platen 2*a* and is likewise mounted on the platen shaft 2*b*.

Figure 2:
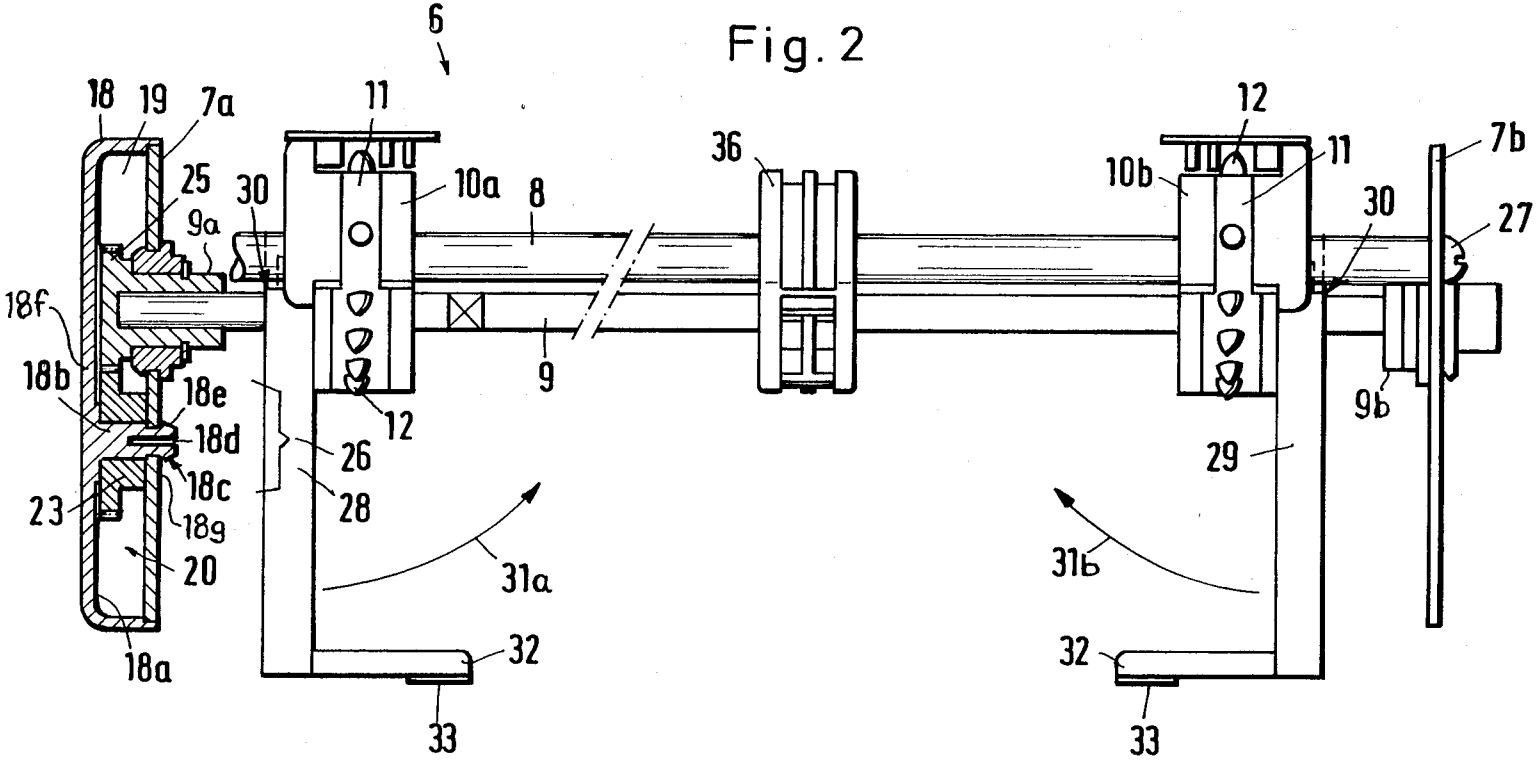
FIG. 2 is a front view of the feeder with sectioned cover and with the printer elements omitted.

The cover 18 has three journals 18*b* (of which only one is shown) formed on the inside 18*a* of the cover 18. Idler gears 21*a*, 22, and 23 are rotatably mounted in the journals 18*b*. As illustrated in FIG. 2 for the idler gear 23, the side support 7*a* guides the idler gears 21*a*, 22, and 23 by a bearing shoulder 18*f*. Journals 18*b* end in heads 18*c* which project through through-holes 18*g* in the side plate 7*a*. Each of the heads 18*c* is provided with a slot 18*d* and has a shoulder 18*e*. Accordingly, a catch 26 is produced from the throughhole 18*g* in the side support 7*a*, the shoulder 18*e*, and the slot 18*d*.

The fastening rod 8 can be axially adjusted by means of setscrews 27 (shown in FIG. 2). The setscrews 27 are supported on the outside by side supports 7*a* and 7*b* to obtain a precise parallel position of the side supports 7*a* and 7*b*—and, thus, also of the fastening rod 8 in relation to the drive shaft 9.

Guide walls 28 and 29 are mounted on the tractors 10*a*, 10*b*, respectively, by joints 30 so that they can swing inwardly in the direction of arrows 31*a* and 31*b*, respectively. The guide walls 28 and 29 help to feed the record carrier 3 and also guide the record carrier 3 laterally during operation. In the feed position, the guide walls 28 and 29 are in parallel to the fastening rod 8 and the drive shaft 9.

To guide the record carrier 3 from below (in addition to the lateral guiding of the record carrier 3 by the guide walls 28 and 29), the guide walls 28 and 29 carry wings 32 on their ends. The wings 32 support the record carrier 3 from below. Each wing 32 itself further mounts a lug 33, which, with suitable construction of the printer frame 1*a* (as shown in FIG. 1), engages a stop 34. Accordingly, a guide shoulder 35 is provided for the record carrier 3.

A further improvement of the guiding for the record carrier 3 is provided by a support 36 (shown in FIG. 2) which can move on the fastening rod 8 and the drive shaft 9 and can always be put in the middle position between the tractors 10*a* and 10*b*.

What is claimed as new and desired to be secured by Letters Patent of the United States is:

1. A printer feeder for feeding edge-punched record carriers to a printer, said printer feeder comprising:

(a) a pair of parallel spaced side supports;

(b) a fastening rod connecting said pair of side supports;

(c) a rotating drive shaft journaled in and extending between said pair of side supports, said rotating drive shaft being parallel to said fastening rod;

(d) a pair of tractors mounted on said fastening rod and said rotating drive shaft between said pair of side supports, each one of said pair of tractors being axially movable on said fastening rod and said rotating drive shaft;

(e) a pair of suspension hooks mounted on each one of said pair of side supports, said pair of suspension hooks being sized, shaped, and positioned to mount the printer feeder on the heads of bolts protruding from a printer;

(f) a drive train comprising a first gear sized, shaped, and positioned to engage a gear integrally mounted on the platen shaft of the printer, a second gear sized, shaped, and positioned to engage a gear mounted on said rotating drive shaft, and at least one additional gear operatively connected between said first gear and said second gear, said drive train being axially outboard of one of said pair of side supports;

(g) a cover mounted on said one of said pair of side supports and surrounding and protecting said drive train, said cover and said one of said side supports forming a largely enclosed housing for said drive train;

(h) a catch mounted on said cover, said catch being sized, shaped, and positioned to engage the printer and to hold the printer feeder in operating position; and (i) journals for said first and second gears and said at least one additional gear formed integrally on the inside of said cover, said journals having heads which project through through-holes in said one of said side supports and shoulders which abut the inside of said one of said side supports to serve as catches between said cover and said one of said side supports.

2. A printer feeder as recited in claim 1 wherein said fastening rod is axially adjustable relative to at least one of said side supports.

3. A printer feeder as recited in claim 1 and further comprising a support for the record carrier, said support being mounted on and axially movable relative to said fastening rod.

4. A printer feeder as recited in claim 1 and further comprising a pair of guide walls for the edges of the record carriers, each one of said pair of guide walls being mounted on and axially adjustable with a corresponding one of said pair of tractors.

5. A printer feeder as recited in claim 4 wherein each one of said pair of guide walls can be pivoted from a first position in which it is perpendicular to said fastening rod to a second position in which it is parallel to said fastening rod.

6. A printer feeder as recited in claim 4 and further comprises a wing mounted on each one of said pair of guide walls, said wings extending perpendicularly to the direction of advance of the record carriers, said wings being sized, shaped, and positioned so that, together with the frame of the printer, they form guide shoulders for the record carriers.

* * * * *